US010083637B1

(12) United States Patent
Gardner

(10) Patent No.: US 10,083,637 B1
(45) Date of Patent: Sep. 25, 2018

(54) PHOTOLUMINESCENT COVER FOR INDICATOR SIGNS

(71) Applicant: William Gardner, Salem, OR (US)

(72) Inventor: William Gardner, Salem, OR (US)

( * ) Notice: Subject to any disclaimer, the term of this patent is extended or adjusted under 35 U.S.C. 154(b) by 0 days.

(21) Appl. No.: 15/866,983

(22) Filed: Jan. 10, 2018

Related U.S. Application Data

(63) Continuation-in-part of application No. 29/612,656, filed on Aug. 2, 2017.

(51) Int. Cl.
*G09F 19/22* (2006.01)
*G09F 13/04* (2006.01)
*G09F 13/20* (2006.01)

(52) U.S. Cl.
CPC ..... *G09F 19/22* (2013.01); *G09F 13/0404* (2013.01); *G09F 13/20* (2013.01)

(58) Field of Classification Search
CPC ..... G09F 19/22; G09F 13/0404; G09F 13/20
See application file for complete search history.

(56) References Cited

U.S. PATENT DOCUMENTS

2005/0198879 A1* 9/2005 Hannington ..... G08B 7/062 40/570
2006/0225326 A1* 10/2006 Robinson ..... G09F 13/20 40/542
2009/0013568 A1* 1/2009 Kwak ..... B60R 13/10 40/208
2010/0018092 A1* 1/2010 Peckham ..... G09F 13/20 40/542
2012/0102799 A1* 5/2012 Roberts ..... G09F 13/18 40/542
2013/0145693 A1* 6/2013 Li ..... G09F 13/20 49/70
2013/0199064 A1* 8/2013 O'Kell ..... G09F 13/18 40/542
2016/0372014 A1* 12/2016 Lee ..... G09F 13/20

* cited by examiner

*Primary Examiner* — Gary C Hoge
(74) *Attorney, Agent, or Firm* — Klarquist Sparkman, LLP

(57) ABSTRACT

A cover can comprise a photoluminescent outer surface, an inner surface configured to be affixed to an indicator sign, and one or more void areas passing through the inner and outer surfaces arranged in a pattern, wherein the pattern defines a negative image in contrast to the photoluminescent outer surface, wherein the negative image corresponds to a graphic on the indicator sign such that the first graphic is visible through the void areas when the cover is affixed to the indicator sign.

20 Claims, 3 Drawing Sheets

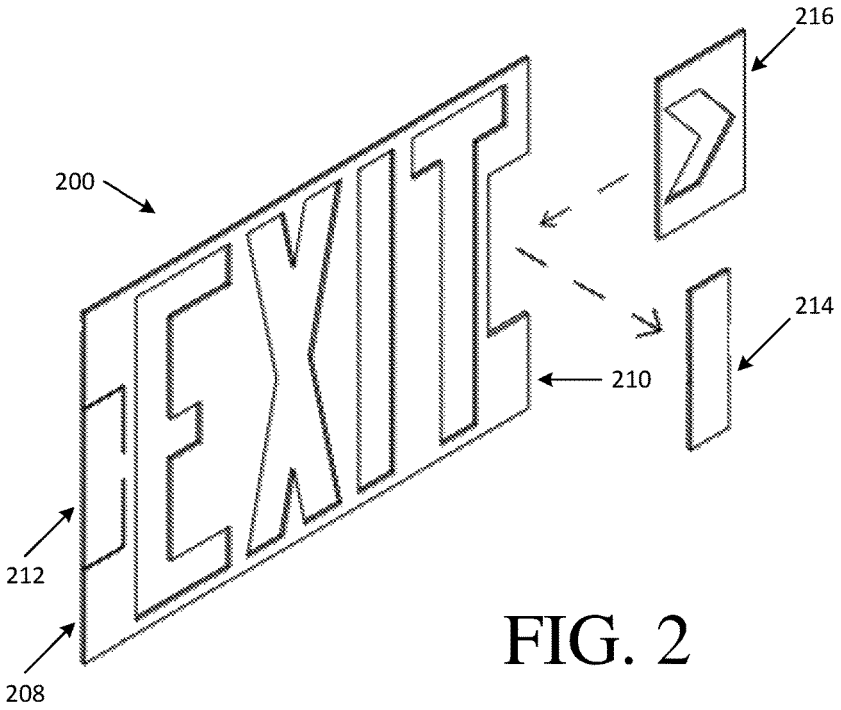
FIG. 2
FIG. 3
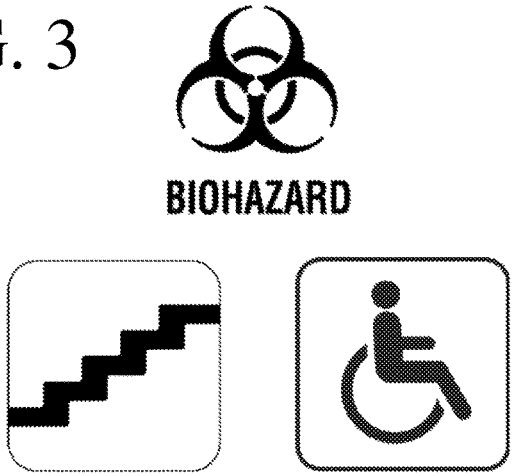

PHOTOLUMINESCENT COVER FOR INDICATOR SIGNS

CROSS-REFERENCE TO RELATED APPLICATION

This application is a continuation-in-part of, and claims the benefit of the priority date of, U.S. Design patent application Ser. No. 29/612,656 filed on Aug. 2, 2017, which is incorporated herein by reference in its entirety.

FIELD

This disclosure generally relates to signage and, more particularly, to photoluminescent covers for indicator signs.

BACKGROUND

As an essential part of public health and safety, indicator signs are required by law in various commercial and residential buildings. These signs can be used to indicate many different things, such as a potential hazard or public access, or to direct individuals to exits in case of fire, or other emergency situations.

SUMMARY

Disclosed herein are exemplary embodiments of photoluminescent covers for indicator signs. In some embodiments, the photoluminescent covers are available for indicator signage where dependable illumination is needed. The disclosed photoluminescent covers can improve, for example, existing sign function by providing a fail-safe for potential indicator sign electrical failure or when there is lighting failure in the area of the sign.

In one representative embodiment, a cover can comprise a photoluminescent outer surface, an inner surface, and one or more void areas arranged in a pattern, such as the word "EXIT". The outer surface can comprise photoluminescent material such that the cover glows in the dark, and the inner surface can be configured to be affixed to the face of an indicator sign, such as via an adhesive or fasteners.

In some embodiments, an adhesive material can be coupled to the inner surface of the cover. In these embodiments, the adhesive can be configured to affix the cover to the front face of an indicator sign. In some embodiments, the pattern can match a graphic on the indicator sign such that the graphic is visible through the void areas when the cover is affixed to the indicator sign.

In some embodiments, the photoluminescent material can absorb light when exposed to a light source and can emit light after the light source is removed. In some embodiments, the photoluminescent material can emit light such that a negative image of the first pattern is visible in the absence of ambient light.

In some embodiments, a first cut-out can be positioned at a first side of the cover. In some embodiments, a second cut-out can be positioned at a second side of the cover, opposite the first side. In some embodiments, the cut-out can be partially removed from the cover.

In some embodiments, an insert can comprise a photoluminescent outer surface, an inner surface, and one or more insert void areas arranged in a second pattern, such as an arrow. The inner surface can be configured to be affixed to the indicator sign. In some embodiments, the second pattern can match a second graphic on the indicator sign such that the second graphic is visible through the insert void areas when the cover is affixed to the indicator sign. In some embodiments, the insert can be shaped to fit into the space created when the first cut-out is removed from the cover.

In another representative embodiment, an indicator sign can comprise a housing, a graphic displayed on a first surface of the housing, and a cover affixed to the first surface of the housing. An outer surface of the cover can comprise a photoluminescent material and the cover can comprise one or more void areas that correspond to the graphic such that the graphic is visible through the void areas.

In some embodiments, an adhesive material can be coupled to an inner surface of the cover. In these embodiments, the adhesive material can be configured to affix the cover to the housing.

In some embodiments, the graphic can be illuminated when electrical power is supplied to the housing. In some embodiments, the photoluminescent material can absorb light when exposed to a light source and can emit light after the light source is removed. In some embodiments, the photoluminescent material can emit light such that a negative image of the graphic is visible in the absence of ambient light. In some embodiments, a negative image of the graphic can be visible when electrical power is not supplied to the indicator sign.

In another representative embodiment, a method can comprise orienting a cover with respect to an indicator sign such that one or more void areas in the cover are aligned with a graphic on a front surface of the indicator sign and pressing an inner surface of the cover against the front surface of the indicator sign to affix the cover to the indicator sign. The outer surface of the cover can contain photoluminescent particles that absorb light when exposed to a light source and emit light when the light source is removed.

In some embodiments, the method can further comprise removing one or more cut-outs from the cover. In some embodiments, the method can further comprise affixing one or more inserts to the front surface of the indicator sign in one or more void areas created in the cover when the one or more cut-outs are removed.

BRIEF DESCRIPTION OF THE DRAWINGS

FIG. 2 is a perspective view of the photoluminescent cover of FIG. 1, pre-cut portions, and optional insert.

FIG. 3 are illustrative examples of common pictographs that the graphic may depict.

DETAILED DESCRIPTION

Figure 1:
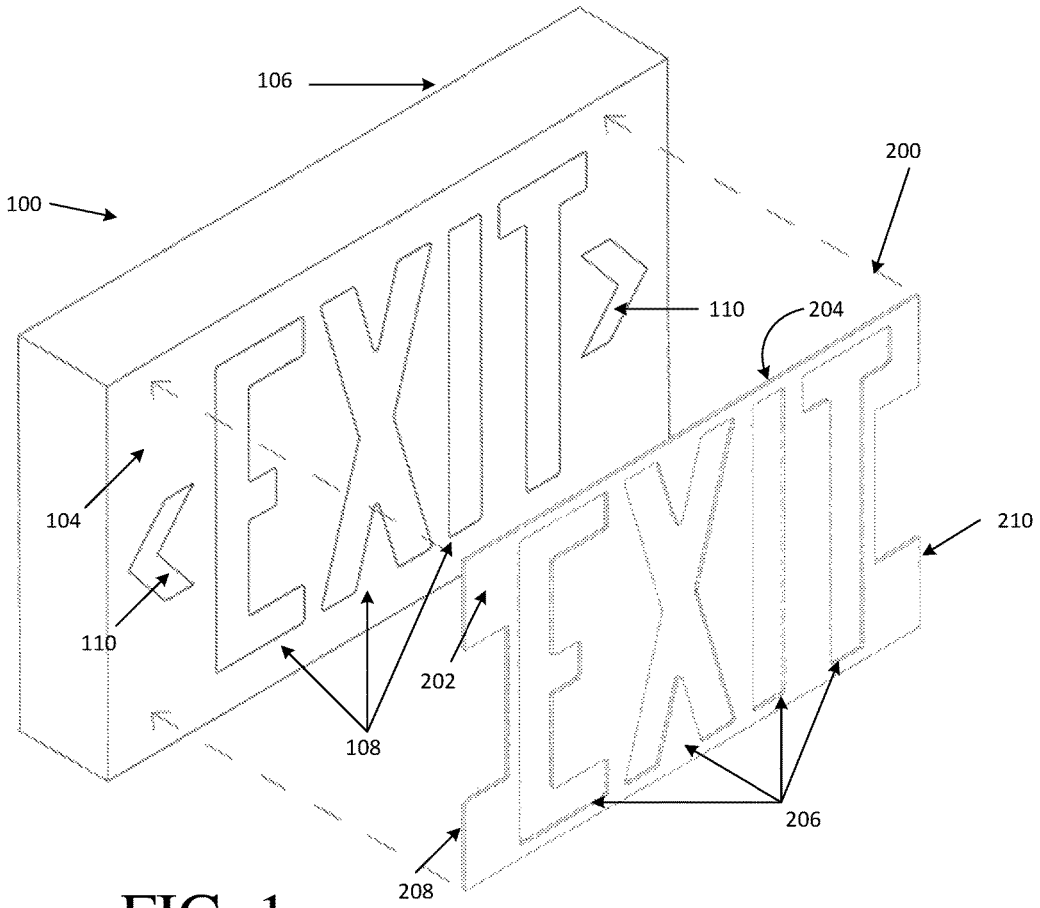
FIG. 1 is an exploded perspective view of an indicator sign and an exemplary embodiment of a cover.

Described herein are exemplary embodiments of photoluminescent covers, components thereof, and methods related thereto. The illustrated embodiments are only preferred examples and is not intended to limit the scope, applicability, or configuration of the disclosure in any way. The described embodiments may vary in function and arrangement of the elements described herein without departing from the scope of the disclosure.

The following explanation of terms and abbreviations used herein are meant to provide a better description of the present disclosure and guide those of ordinary skill in the art in the practice of the present disclosure. The terms "includes" and "has" have the same meaning as "comprises," and the terms "including" and "having" have the same meaning as "comprising." Also, the singular terms "a," "and," and "the," mean both the singular and the plural unless the term is qualified to expressly indicate that it only refers to a singular element. That is, if two of a particular element are present, there is also "a" or "an" of such element that is present. In addition, the term "and/or" when used in this disclosure is to be construed to include the conjunctive "and," the disjunctive "or," and both "and" and "or."

As used herein, the term "coupled" means physically, magnetically, chemically, electrically, or otherwise connected or linked, which includes items that are directly coupled and items that are coupled with intermediate elements between the coupled items, unless specifically stated to the contrary. The term "or" refers to a single element of stated alternative elements or a combination of two or more elements, unless the context clearly indicates otherwise. The term "plurality" means two or more of the specified elements.

Indicator signs are required by law in various commercial and residential buildings. Many of these signs are connected to electrical power through an existing AC electrical connection, with most depending on a battery back-up system in case of power outage. The electrical power can be used to illuminate a graphic such as the word 'EXIT' on an indicator sign. However, in the event of complete electrical power loss, the graphic on an indicator sign may not become illuminated. For example, in cases of power loss, roughly thirty percent of exit signs with a battery back-up fail, while those without a battery back-up are certain to fail. And in the event of power loss, other lights in the building are no longer illuminating the signs. Because of this potential for failure and resulting dangers, a cheap and dependable fail-safe cover is desirable.

The photoluminescent covers disclosed herein can be used to retrofit an existing indicator sign or can be combined with a newly manufactured sign to form a new product. The photoluminescent cover can create a "negative" image of an indicator sign graphic to ensure proper visibility of the graphic without the need for electrical power. Constant maintenance, testing, and the cost of replacing existing indicator signs can place a burden on employers, landlords, and public institutions that use indicator signs. The disclosed photoluminescent cover can provide a more cost-effective and time-effective option in how they proceed in ensuring that public health and safety requirements are met.

FIG. 1 shows an example indicator sign 100, which can be installed in various types of commercial and residential buildings, such as apartment complexes, office buildings, arenas, etc. The indicator sign 100 can comprise an outwardly facing front surface 104 as well as various electrical components such as a battery or light source positioned within an electrical housing and/or frame 106. The surface 104 can comprise a graphic 108 which can include text, pictographs, symbols, etc. In the illustrated example of FIG. 1, the graphic 108 displays the word 'EXIT' to direct individuals to an exit. In other examples, the graphic 108 can contain any other word, phrase or image to identify an exit or a hazard of make any other type of indication (see FIG. 3 for some examples). The graphic 108 can be cut, molded or cast into surface 104, which can comprise a colored translucent backing, allowing an interior light source positioned inside of the housing 106 to illuminate the resulting graphic 108. Alternatively, the indicator sign 100 can be a plate-like structure made of acrylic or glass in which the graphic 108 comprises a solid colored material encased in a transparent face or frame. Alternatively, the sign 100 may have differing physical characteristics such as curvature, shape, forms of illumination, etc. Additionally, the surface 104 of the sign 100 can have additional graphics 110, such as chevrons, arrows, or other indicators. In the illustrated example of FIG. 1, the graphics 110 are arrows or chevrons that indicate the direction of an exit. Typically, only one arrow pointing in a single direction would be present on the surface 104.

Testing and maintaining housing and hard-wired connections of an indicator sign such as sign 100 can be time consuming and costly. As such, these tasks are often ignored, which can increase the potential for the indicator sign to fail during power loss. The disclosed photoluminescent cover can, however, provide an easily installable way of ensuring proper indicator sign illumination without inhibiting the functionality of the sign.

Still referring to FIG. 1, an exemplary photoluminescent cover 200 can comprise an outer surface 202, an inner surface 204, and void areas 206 where there is no material or transparent material present. The void areas 206 can be arranged in a pattern to match the graphic 108 of the indicator sign 100 such that when the cover 200 is affixed to the surface 104, the graphic 108 is visible through the void areas 206. The cover 200 can comprise a rigid or flexible material and a photoluminescent material in the outer surface 202. The photoluminescent material can be evenly distributed over the non-void area of the surface 202 of the cover 200 or distributed in any other manner. An embedded pigment is one example of a photoluminescent material that can be used.

The photoluminescent material can absorb photons from any nearby light source, such as a light emitting diode, fluorescent lighting, white light, a halide lamp, sunlight, light emitted by a bulb inside the indicator sign, etc. After absorbing photons for some time, the photoluminescent material can later emit light once the light source is removed, for example through the process of atomic photoexcitation. This will result in a negative image of the void areas 206 being produced. That is, the photoluminescent material can emit light from the entirety or a substantial portion of the surface 202 of the cover 200 except from the void areas 206, corresponding to the graphic 108. This can allow an image of the graphic 108 to be seen in the dark even when the indicator sign 100 has no electrical power.

Photoluminescent materials can comprise various chemical compounds such as Strontium Aluminate (SrAl), Zinc Sulfide (ZnS), Yttrium Oxide Sulfide ($Y_2O_2S$), etc. These materials can be classified by their visibility and duration of light emission (typically measured in millicandelas per area, $mcd/m^2$) and certain materials can allow the cover 200 to emit light for at least 90 minutes in the absence of ambient light, which meets the required specifications for many applications. Further, the photoluminescent material can be chosen to emit any color or combination of colors to meet any required regulations or to meet customer demands for particular aesthetic qualities.

The photoluminescent cover 200 can comprise a rigid material such as PVC, aluminum, acrylic, and/or a flexible material such as polyester, vinyl, PVC, etc. A rigid or flexible cover 200 can be manufactured by mixing a photoluminescent material into a range of materials used in injection molding, casting, or the production of substrates. Alternatively, the cover can comprise a prefabricated photoluminescent substrate and/or a photoluminescent ink, suitable for screen printing, plotter-cutting, die-cutting, thermal transfer printing or any process enabling variations of the photoluminescent graphic 206 to be produced on the first surface 202.

In some examples, the void areas 206 can be replaced with a transparent material sized and shape to match the graphic 108 such that the graphic is visible through the transparent material. Alternatively, the void areas 206 can comprise of any material not having photoluminescent properties that allows for the graphic 108 of the indicator sign 100 to be seen when the cover 200 is affixed to the surface 104. In some examples, the cover 200 can comprise a braille component and/or an auditory component on the first surface 202 to communicate the same information that the graphic 108 communicates.

The inner surface 204 can comprise any type of material to affix the cover 200 to the surface 104 of the indicator sign 100. For example, a pressure sensitive adhesive can provide a uniform and confined bonding area, allowing for quick surface bonding of the inner surface 204 to the surface 104. An adhesive coupled to the surface 204 can contain a removable liner overlay that allows the cover 200 to be effectively stored and provide a peel and apply adhesive for easy and consistent installation. The adhesive can cover the entire surface area of the inner surface 204 or any portion thereof. Further, the cover 200 can be affixed to the surface 104 through other means, such as clamps, screws, pins, etc.

Referring to FIG. 2, the cover 200 can comprise cut-outs 212 and 214 on either side. These cut-outs can comprise partially pre-cut portions that can either be left attached or easily removed from the cover to create one or more additional void areas. The pre-cut portions 212, 214 can be attached to the cover 200 by a plurality of perforations, one or more tabs, or any other method for allowing the removal of the pre-cut portions 212, 214 and/or allowing the pre-cut portions 212, 214 to stay fastened to the cover 200. The cut-outs 212, 214 can be sized and positioned such that they correspond to graphics 110 on the indicator sign 100 such that when they are removed and the cover 200 is affixed to the sign 100, the graphics are visible through the void areas created by the removal of the cut-out portions. In the illustrated example of FIGS. 1 and 2, the cut-outs can be removed to expose the chevrons 110 on the indicator sign 100.

In typical use, an emergency exit sign will either have one chevron illuminated to indicate the direction of an exit or no chevrons illuminated to indicate that an exit is present below the indicator sign. In examples where an emergency exit has one chevron illuminated, the cut-out 212 or 214 corresponding to the illuminated chevron can be removed to expose that chevron. In examples where an emergency exit has no chevron illuminated, the cut-outs 212, 214 can be left attached to the cover 200. In other examples, both pre-cut portions 212, 214 can be remove to expose graphics 110 on both sides of the indicator sign 100.

Referring back to FIG. 2, one or more inserts 216 can be affixed to the indicator sign 100 in the space where a cut-out 212 and/or 214 was removed. The insert 216 can share the same material or aesthetic qualities as cover 200 having an outer surface with photoluminescent material and an inner surface that can be affixed to the surface 104 of the indicator sign 100. The insert 216 can have a void area that corresponds to graphic 110 such that graphic 110 is visible through the void area when the insert is affixed to the sign 100.

Figure 4:
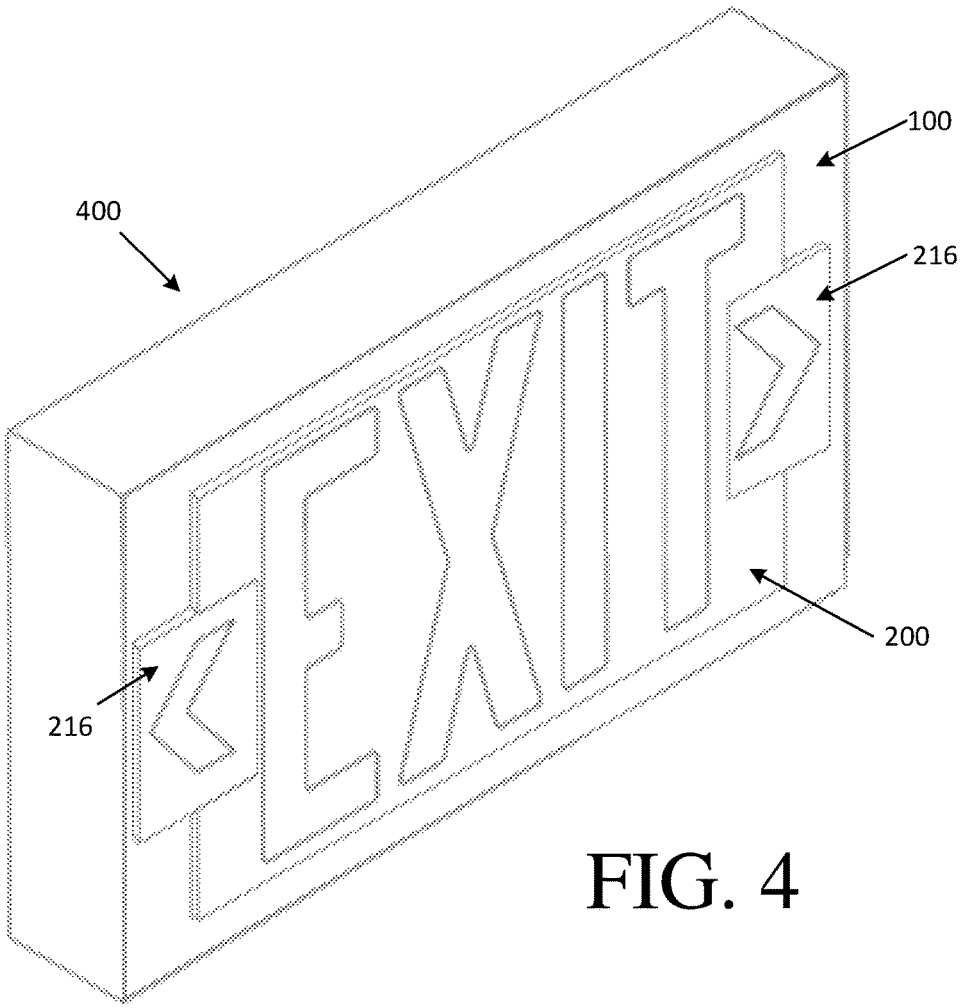
FIG. 4 is a perspective view of the resulting combination of the indicator sign and photoluminescent cover.

FIG. 1 illustrates a method for attaching the photoluminescent cover 200 to an indicator sign 100 to form an indicator sign combination 400, as shown in FIG. 4. The indicator sign combination can be formed by first removing pre-cut portions 212 and/or 214 if so desired. The void areas 206 can then be aligned with the graphic 108 and the inner surface 204 of the cover 200 can be placed against the surface 104 of the indicator sign 100 and affixed thereto by an adhesive or other means. If desired, one or more inserts 216 can be similarly affixed to the surface 104 of the indicator sign 100 at the locations where one or more pre-cut portions 212, 214 were removed. The cover 200 can then be left exposed to a nearby light source such that the photoluminescent material on the outer surface 202 of the cover can absorb photons. In the event of an emergency involving the loss of power and lighting, the photoluminescent material can emit light from the surface 202 of the cover 200 thereby creating a negative image of the graphic 108.

The cover 200 can be manufactured in a number of sizes and shapes in order to prevent any overlap or interference with any of the features or housing of the indicator sign 100. If a dependable light source neighbors the combination 400, the battery back-up and future testing of the indicator sign 100 may no longer be required since the cover 200 will be dependably illuminated in an emergency. The indicator sign combination 400 improves on the functionality of indicator signage by providing the public, residents, employees, and others, the information they need at a moment's notice in the event of an emergency, even if the indicator sign 100 fails.

The disclosed cover 200 can have any dimensions, and is not limited to the proportions shown in the drawings. For example, adhesives, films, and rigid materials can have various weights, widths, heights, thicknesses, or lengths. Further, indicator signs can have various widths, heights, or lengths.

The disclosed cover 200 can also have varying adhesive tensile and shear strengths. For example, a cover can comprise removable adhesive such that it can be easily removed from the indicator sign 100 and replaced with a new cover. The disclosed cover can also have additional prismatic or reflective characteristics to provide for further aesthetic or visibility properties.

In view of the many possible embodiments to which the principles of the disclosed technology may be applied, it should be recognized that the illustrated embodiments are only preferred examples of the disclosed technology and should not be taken as limiting the scope of the disclosed technology. Rather, the scope of the disclosure is at least as broad as the following claims. I therefore claim all that comes within the scope of these claims.

The invention claimed is:

1. A cover comprising:

a photoluminescent outer surface;

an inner surface configured to be affixed to an indicator sign; and one or more void areas passing through the inner and outer surfaces arranged in a pattern, wherein the pattern defines a negative image in contrast to the photoluminescent outer surface, wherein the pattern corresponds to a graphic on the indicator sign such that the graphic is visible through the void areas when the cover is affixed to the sign.

2. The cover of claim 1, further comprising an adhesive material coupled to the inner surface, wherein the adhesive is configured to affix the cover to the indicator sign.

3. The cover of claim 1, wherein the photo luminescent outer surface comprises an embedded photoluminescent pigment.

4. The cover of claim 1, wherein the photoluminescent outer surface absorbs light when exposed to a light source and emits light after the light source is removed.

5. The cover of claim 1, wherein the photoluminescent outer surface emits light such that a negative image of the first pattern is visible in the absence of ambient light.

6. The cover of claim 1, further comprising a first cut-out positioned at a first side of the cover.

7. The cover of claim 6, further comprising a second cut-out positioned at a second side of the cover, opposite the first side.

8. The cover of claim 6, wherein the first cut-out is partially removed from the cover.

9. The cover of claim 6, further comprising an insert comprising:

a second photoluminescent outer surface;

a second inner surface, configured to be affixed to the indicator sign; and one or more insert void areas arranged in a second pattern.

10. The cover of claim 9, wherein the second pattern matches a second graphic on the indicator sign such that the second graphic is visible through the insert void areas when the cover is affixed to the indicator sign.

11. The cover of claim 9, wherein the insert is shaped to fit into the space created when the first cut-out is removed from the cover.

12. An indicator sign comprising:

a housing;

a graphic displayed on a surface of the housing; and a cover affixed to the surface of the housing, wherein an outer surface of the cover comprises a photoluminescent material, wherein the cover comprises one or more void areas that correspond to the graphic such that the graphic is visible through the void areas, and wherein the photoluminescent outer surface produces a negative image of the graphic in contrast with the void areas.

13. The indicator sign of claim 12, wherein an adhesive is coupled to an inner surface of the cover, wherein the adhesive is configured to affix the cover to the housing.

14. The indicator sign of claim 12, wherein the graphic is illuminated when electrical power is supplied to the housing.

15. The indicator sign of claim 12, wherein the photoluminescent material absorbs light when exposed to a light source and emits light after the light source is removed.

16. The indicator sign of claim 12, wherein the photoluminescent material emits light such that a negative image of the graphic is visible in the absence of ambient light.

17. The indicator sign of claim 12, wherein a negative image of the graphic is visible when electrical power is not supplied to the indicator sign.

18. A method comprising:

orienting a cover with respect to an indicator sign such that one or more void areas in the cover are aligned with a graphic on a front surface of the indicator sign; and coupling an inner surface of the cover to the front surface of the indicator sign, wherein an outer surface of the cover comprises a photoluminescent material that absorbs light when exposed to a light source and emit light when the light source is removed, wherein the photoluminescent outer surface produces a negative image of the graphic in contrast with the void areas.

19. The method of claim 18, further comprising removing one or more cut-outs from the cover.

20. The method of claim 18, further comprising affixing one or more inserts to the front surface of the indicator sign in one or more void areas created in the cover when the one or more cut-outs are removed.

* * * * *